US007856764B2

(12) United States Patent
Kortuem et al.

(10) Patent No.: US 7,856,764 B2
(45) Date of Patent: Dec. 28, 2010

(54) CATHEDRAL CEILING VENT BAFFLE

(75) Inventors: Matt Kortuem, Blandon, PA (US); Palle Rye, Shillington, PA (US); Dave Rosten, Sinking Spring, PA (US); Richard L. Partlow, Jr., Reading, PA (US)

(73) Assignee: Brentwood Industries, Inc., Reading, PA (US)

( * ) Notice: Subject to any disclaimer, the term of this patent is extended or adjusted under 35 U.S.C. 154(b) by 872 days.

(21) Appl. No.: 11/760,431

(22) Filed: Jun. 8, 2007

(65) Prior Publication Data

US 2007/0283639 A1 Dec. 13, 2007

Related U.S. Application Data

(60) Provisional application No. 60/804,476, filed on Jun. 12, 2006.

(51) Int. Cl.
*F24F 7/02* (2006.01)
*E04B 7/18* (2006.01)
*E04D 13/17* (2006.01)

(52) U.S. Cl. ..... 52/95; 52/199; 52/302.3; 454/260; 454/366

(58) Field of Classification Search ..... 52/95, 52/199, 302.1, 302.3; 454/260, 366
See application file for complete search history.

(56) References Cited

U.S. PATENT DOCUMENTS 2,855,869 A 10/1958 Munters ..... 108/6
3,797,180 A * 3/1974 Grange ..... 52/95
3,972,164 A * 8/1976 Grange ..... 52/95
4,096,790 A 6/1978 Curran ..... 98/37
4,102,092 A * 7/1978 Ward ..... 52/95
4,189,878 A * 2/1980 Fitzgerald ..... 52/95
4,237,672 A * 12/1980 Peterson ..... 52/742.1
4,254,598 A * 3/1981 Rugroden ..... 52/199
4,446,661 A * 5/1984 Jonsson et al. ..... 52/95
4,642,958 A * 2/1987 Pewitt ..... 52/302.3
4,660,463 A * 4/1987 Bottomore et al. ..... 454/260
4,776,262 A * 10/1988 Curran ..... 454/260
5,044,821 A * 9/1991 Johnsen ..... 405/50
5,341,612 A * 8/1994 Robbins ..... 52/95
5,489,462 A * 2/1996 Sieber ..... 428/174
5,596,847 A 1/1997 Stephenson ..... 52/198
5,600,928 A * 2/1997 Hess et al. ..... 52/309.4

(Continued)

FOREIGN PATENT DOCUMENTS

GB 2 145 756 A * 4/1985

*Primary Examiner*—Robert J Canfield
(74) *Attorney, Agent, or Firm*—Miller Law Group, PLLC

(57) ABSTRACT

A vent baffle assembly provides air ventilation in a cathedral ceiling having rafter beams and roof sheathing. The vent baffle assembly includes a first vent sheet and a second vent sheet. The first vent sheet has first and second ends, first and second longitudinal ribs and a first lateral stiffener extending generally perpendicularly to the ribs. The second vent sheet includes third and fourth ends, third and fourth longitudinal ribs, and a second lateral stiffener extending perpendicularly to the ribs. The first vent sheet is positioned between adjacent rafters with the ribs oriented parallel to the rafters. The second vent sheet overlaps the first vent sheet with respective ribs interengaged to limit lateral movement of the first vent sheet relative to the second vent sheet. The first lateral stiffener engages the second lateral stiffener to limit longitudinal movement of the first vent sheet relative to the second vent sheet.

20 Claims, 7 Drawing Sheets

U.S. PATENT DOCUMENTS

| | | | | |
|---|---|---|---|---|
| 5,941,028 | A * | 8/1999 | Hicks | 52/95 |
| 6,347,991 | B1 | 2/2002 | Bogrett | 454/260 |
| 6,357,185 | B1 * | 3/2002 | Obermeyer et al. | 52/95 |
| 7,094,145 | B2 | 8/2006 | Rye | 454/366 |
| 7,302,776 | B2 * | 12/2007 | Duncan et al. | 52/95 |
| 7,458,189 | B2 * | 12/2008 | Pollack | 52/302.1 |
| 2005/0072072 | A1 | 4/2005 | Duncan | 52/198 |
| 2005/0160684 | A1 * | 7/2005 | Duncan | 52/95 |
| 2006/0105699 | A1 * | 5/2006 | Kortuem et al. | 454/260 |
| 2007/0151176 | A1 * | 7/2007 | Mumaw et al. | 52/198 |
| 2007/0151177 | A1 * | 7/2007 | Mumaw et al. | 52/198 |
| 2008/0163565 | A1 * | 7/2008 | Toas | 52/95 |
| 2009/0056236 | A1 * | 3/2009 | Rosten | 52/79.1 |
| 2009/0311959 | A1 * | 12/2009 | Shepherd | 454/366 |
| 2010/0064602 | A1 * | 3/2010 | Moore | 52/95 |

* cited by examiner

Fig. 6
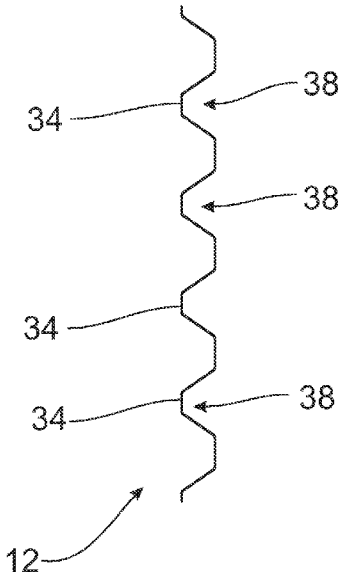
Fig. 7
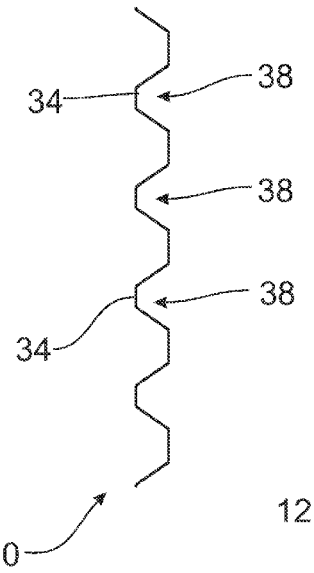
Fig. 8
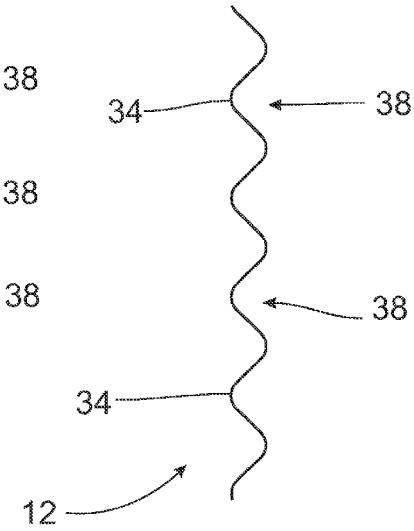
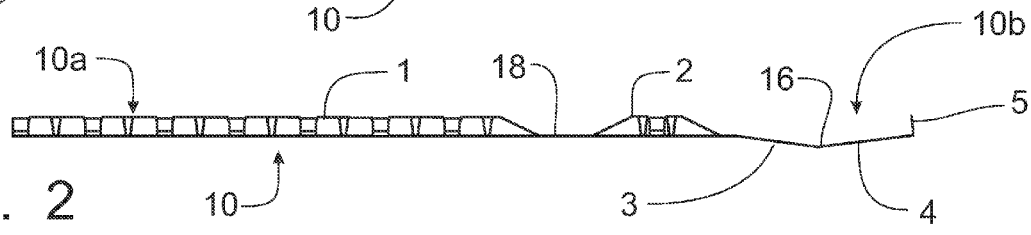
Fig. 2

CATHEDRAL CEILING VENT BAFFLE

CROSS-REFERENCE TO RELATED APPLICATIONS

This application claims domestic priority on U.S. Provisional Patent Application Ser. No. 60/804,476, file Jun. 12, 2006, the contents of which are incorporated herein by reference.

BACKGROUND OF THE INVENTION

Vent baffles are utilized in building structures to vent an area beneath the roof between a soffit and a peak of the building to prevent moisture buildup. Moisture in the roof can potentially damage attic insulation and the building structure itself. Proper ventilation aids in the prevention of premature melting of snow accumulated on a roof. Premature snow melting may lead to the formation of ice on the roof, which is a potential safety hazard and may also damage the roof.

Providing attic ventilation for cathedral ceilings presents unique challenges because drywall or alternative wall boards are secured directly to the inner sides of the roof rafters, leaving a relatively small space between the drywall or wallboards and the roof sheathing of the building. Accordingly, this space is relatively small and must accommodate venting structure and insulation. Conventional cathedral ceilings typically are constructed utilizing ventilation sheets mounted in an end-to-end configuration to the roof sheathing, insulation positioned over the ventilation sheets and drywall or other ceiling sheets mounted to a bottom of the rafters over the insulation. Such installation is labor intensive and misalignment of the vent sheets could potentially inhibit or block the desired flow of air in channels created by the vent sheets from the soffit area to the outlet or ridge of the building structure. Air flow may be blocked if insulation creeps between gaps created between misaligned end-to-end vent sheets, thereby defeating the purpose of or severely limiting the effectiveness of the vent sheets.

Cathedral ceilings may include an attic space near the soffit area of the building proximate the top of the wall and the lower edge of the roof. This area may be insulated by conventional blown insulation that rests on the floor of the attic. Such blown insulation is preferably protected from wind that blows into the soffit area of the building. Uncontrolled air currents circulating in the attic space can have a negative effect on the performance of the attic insulation by promoting increased convective heat transfer along the top surface of the insulation. A roof ventilation system for blocking air from disturbing the blown insulation and enhancing ventilation of the attic space in the soffit area is described in U.S. Pat. No. 7,094,145, granted to Palle Rye, et al on Aug. 12, 2006, from a patent application filed on Mar. 29, 2004, which is co-owned with the instant application and is incorporated herein in its entirety by reference. U.S. Pat. No. 7,094,145 describes a vent baffle and method of installation that may be utilized in the soffit area of a building structure; however, this vent baffle may also be utilized in building structures having a cathedral ceiling-type construction.

A roof constructed of a water impervious outer layer and a water impervious inner layer with an insulating layer therebetween is formed with ventilating channels in U.S. Pat. No. 2,855,869, granted to Carl Munters, et al on Oct. 14, 1958. These ventilating channels extend from the eaves to the wall header along the width of the roof to remove moisture from the insulating layer. The ventilation baffle in U.S. Pat. No. 4,096,790, granted on Jun. 27, 1978, to Laurence Curran, is secured to the tops of the rafters by the roof sheathing and includes a vertical flap that is secured to the sill at the top of the wall to prevent insulation from entering the soffit area from the interior of the building.

U.S. Pat. No. 5,596,847, issued on Jan. 28, 1997, to Michael Stephenson, discloses a polystyrene foam vent structure that is formed with longitudinal ribs, one of which includes a score line to permit the vent panel to be cut into a size that conforms to a smaller spacing of the roof rafters. The vent panel is placed on top of adjacent rafters to provide an air space past the insulation layer. A similar vent panel is taught in U.S. Pat. No. 6,347,991, issued to Blake Bogrett, et al, on Feb. 19, 2002, in which the PVC panel is formed with a central rib to be mounted on top of adjacent roof rafters to provide an air space past the insulation layer. This PVC vent panel is also formed with a hinged chute segment that can be folded downwardly to be affixed to the top sill or the wall to provide an insulation dam. Multiple fold lines in the hinged chute segment provide flexibility in the attachment of the insulation dam.

U.S. Patent Publication No. 2005/0072072 of Richard Duncan, et al, published on Apr. 7, 2005, discloses a baffle vent that is mounted between two adjacent rafters by a friction fit. This baffle vent is also formed with a central longitudinal rib and transverse thickened supports to provide lateral support and stability. A transversely extending perforation is located along one of the transverse supports to permit the baffle vent to be separated along the perforation to form a baffle vent having a shortened length.

The nature of the construction and configuration of a cathedral ceiling requires air ventilation along the entire length of the cathedral ceiling area of the building structure or, at times, from the soffit area to the peak of the building structure. There is a need for a cathedral ceiling vent baffle that is inexpensively manufactured, effectively provides ventilation for the cathedral ceiling, provides a space for insulation between the drywall and roof sheathing of the cathedral ceiling, is quickly and easily installed, and is adaptable for a wide range of cathedral ceiling building configurations.

SUMMARY OF THE INVENTION

It is an object of this invention to provide a ceiling vent baffle that can be used in the construction of cathedral ceilings.

It is a feature of this invention that the cathedral ceiling vent baffle provides ventilation for a cathedral ceiling while providing adequate space for the installation of insulation between the baffle vent and the ceiling structure affixed to the roof rafters.

It is an advantage of this invention that the ceiling vent baffle can be installed into a cathedral ceiling structure quickly and easily.

It is another feature of this invention that the cathedral ceiling vent baffle is adaptable for a wide range of cathedral ceiling building configurations.

It is still another feature of this invention that the cathedral ceiling vent baffle is formed with longitudinally extending ribs that interengage with the installation of the vent sheets to the roof sheeting.

It is another advantage of this invention that the interengaged longitudinally extending ribs of the first and second vent sheets limit the lateral movement of the first vent sheet relative to the second vent sheet.

It is yet another feature of this invention that the vent sheets are also formed with lateral stiffeners that are interengaged when the vent sheets are installed on the roof sheeting.

It is still another advantage of this invention that the interengaged lateral stiffeners limits the longitudinal movement of the first vent sheet relative to the second vent sheet.

Briefly stated, a preferred embodiment of the present invention is directed to a vent baffle assembly for a cathedral ceiling to provide air ventilation in a cathedral ceiling portion of a building structure having rafter beams and a roof sheathing. The vent baffle assembly includes a first vent sheet having a first end, a second end, a first side, a second side, a first longitudinal rib, a second longitudinal rib and a first lateral stiffener extending generally perpendicularly relative to the first and second longitudinal ribs. The first and second longitudinal ribs extend from the first end toward the second end. A second vent sheet includes a third end, a fourth end, a third side, a fourth side, a third longitudinal rib, a fourth longitudinal rib and a second lateral stiffener extending generally perpendicularly relative to the third and fourth longitudinal ribs. The third and fourth longitudinal ribs extend from the third end toward the fourth end. The first vent sheet is positioned between two adjacent rafter beams such that the first and second longitudinal ribs extend generally parallel to the rafter beams. The second vent sheet is positioned between the two adjacent rafter beams such that the third longitudinal rib engages the first longitudinal rib and the second longitudinal rib engages the fourth longitudinal rib to limit lateral movement of the first vent sheet relative to the second vent sheet. The first lateral stiffener engages the second lateral stiffener to limit longitudinal movement of the first vent sheet relative to the second vent sheet in an installed configuration.

It is yet another object of this invention to provide a ceiling vent baffle that can be utilized in cathedral ceiling construction and which is durable in construction, inexpensive of manufacture, carefree of maintenance, facile in assemblage, and simple and effective in use.

These and other objects, features and advantages are accomplished according to the instant invention by providing a vent baffle assembly that provides air ventilation in a cathedral ceiling having rafter beams and roof sheathing. The vent baffle assembly includes a first vent sheet and a second vent sheet. The first vent sheet has first and second ends, first and second longitudinal ribs and a first lateral stiffener extending generally perpendicularly to the ribs. The second vent sheet includes third and fourth ends, third and fourth longitudinal ribs, and a second lateral stiffener extending perpendicularly to the ribs. The first vent sheet is positioned between adjacent rafters with the ribs oriented parallel to the rafters. The second vent sheet overlaps the first vent sheet with respective ribs interengaged to limit lateral movement of the first vent sheet relative to the second vent sheet. The first lateral stiffener engages the second lateral stiffener to limit longitudinal movement of the first vent sheet relative to the second vent sheet.

BRIEF DESCRIPTION OF THE DRAWINGS

The advantages of this invention will be apparent upon consideration of the following detailed disclosure of the invention, especially when taken in conjunction with the accompanying drawings wherein:

FIG. 2 is an elevational view of the starter vent shown in FIG. 1 with the interior surface being on the lower side of the figure as the starter vent would be installed, as depicted in FIG. 8;

FIG. 6 is a cross-sectional view of the intermediate vent sheet corresponding to lines 6-6 of FIG. 5;

FIG. 7 is a cross-sectional view of the starter vent sheet corresponding to lines 7-7 of FIG. 3;

FIG. 8 is a cross-sectional view of the intermediate vent sheet corresponding to lines 8-8 of FIG. 5;

DETAILED DESCRIPTION OF THE PREFERRED EMBODIMENT

Figure 1:
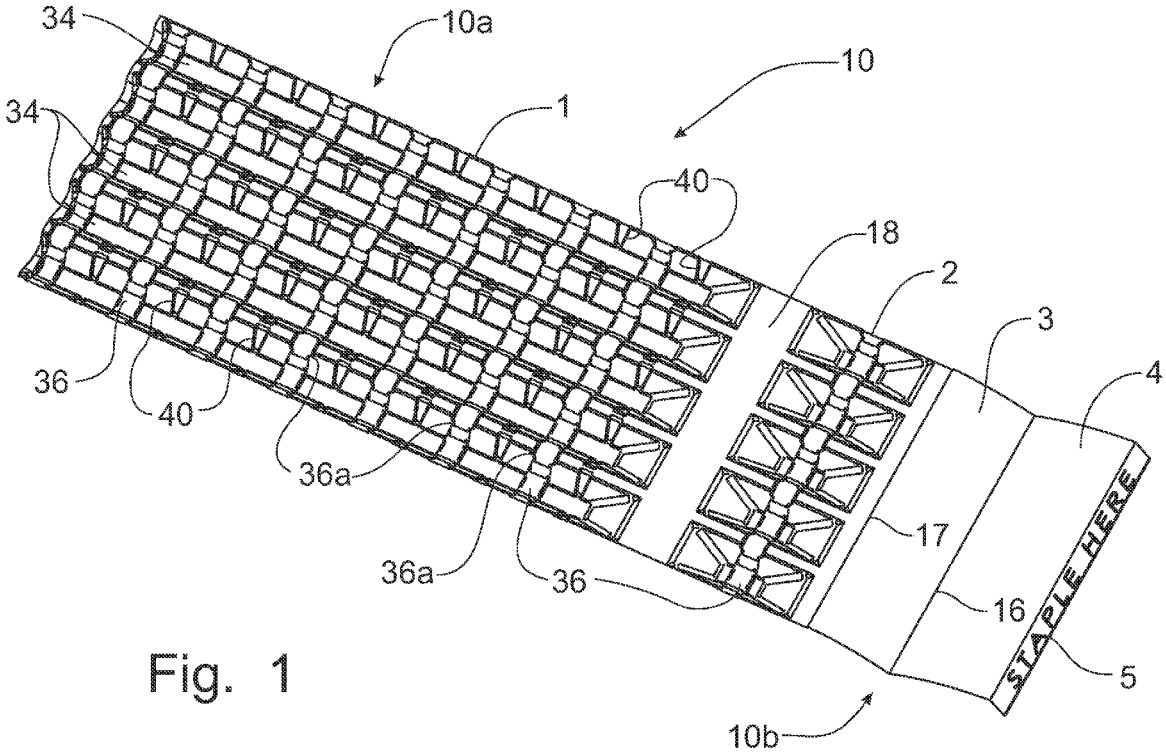
FIG. 1 is a perspective view showing the interior surface of a starter vent sheet of the vent baffle assembly in accordance with a first preferred embodiment of the present invention.

Certain terminology is used in the following description for convenience only and is not limiting. The words, "right", "left", "up", "down", "top", and "bottom" designate directions in the drawings to which reference is made. The words, "interior" and "exterior" refer to directions toward and away from, respectively, the geometric center of the cathedral ceiling vent assembly or designated parts or portions thereof. Furthermore, as used herein, the article, "a" or a singular component includes the plural or more than one component, unless specifically and explicitly restricted to the singular or a single component or unless a singular meaning is apparent from the context. The terminology includes the words above specifically mentioned, derivatives thereof and words of similar meaning.

Referring to the drawings in detail, wherein like reference numerals are used to identify like components throughout, there are shown in FIGS. 1-10, preferred embodiments of a cathedral ceiling vent baffle assembly. The vent baffle assembly of the preferred embodiments includes a starter vent sheet 10 and an intermediate vent sheet 12. The intermediate vent sheet or sheets 12 and/or the starter vent sheet or sheets 10 are assembled in a cathedral ceiling portion of a building structure to vent air in a roof 14 of a building to generally limit or prevent moisture buildup proximate the roof 14. Other configurations for the shape and design of the vent sheets 10, 12 will be appreciated by one of ordinary skill in the art. One such alternative design configuration is shown in FIG. 5A of Applicants' provisional patent application U.S. Ser. No. 60/804,476, for which domestic priority is claimed.

Referring to FIGS. 1-4, 8 and 9, the starter vent sheet 10 includes a ribbed main body portion 10*a* and a tail portion 10*b*. In use, the tail portion 10*b* is preferably secured to the building structure and the main body portion 10 provides ventilation along the underside of the roof 10 to create channels for airflow to draw moisture away from the roof 14. The main body portion 10*a* is ribbed longitudinally to provide airflow channels and longitudinal stiffness, while the tail portion 10*b* is preferably comprised of generally planar sections of sheet-like material that is convenient for mounting to the building structure and may also be readily bent or formed for adapting to various shapes that are convenient during installation, as will be described in greater detail below.

The starter vent sheet 10 and intermediate vent sheet 12 are preferably constructed of a sheet of polymeric material having a thickness of approximately one one-hundredth to four one-hundredths of an inch (0.010"-0.040"). Sheet metals, thermoplastics and composite materials may all be utilized to form the starter vent sheet 10 or the intermediate vent sheet 12 or nearly any material that is able to take on the general shape of the starter and intermediate vent sheets 10, 12 and perform the typical functions of the starter and intermediate vent sheets 10, 12.

A press-molded thermoplastic material is the preferred material for the starter and intermediate vent sheets 10, 12 and the most preferred thermoplastic material is a polyvinyl chloride (PVC) material. The PVC material is preferred for construction of the starter and intermediate vent sheets 10, 12 due to its adaptability to the molding process, resistance to corrosion and relatively light weight. However, the starter and intermediate vent sheets 10, 12 are not limited to constructions utilizing the PVC material and may be constructed using nearly any material that is able to take on the general shape of the starter and intermediate vent sheets 10, 12 and withstand the normal operational environment of the starter and intermediate vent sheets 10, 12.

The starter vent sheet 10 includes a first stiffened panel 1, a second stiffened panel 2, a first non-ribbed section 3, a second non-ribbed section 4 (either of the non-ribbed sections could be planar or radiused slightly), and a mounting flange 5. Each of these portions of the starter vent sheet 10 is preferably constructed of integrally molded PVC material. The first and second stiffened panels 1, 2 preferably comprise the main body portion 10*a* and the first and second non-ribbed sections 3, 4 and the mounting flange 5 preferably comprise the tail portion 10*b*. The starter vent sheet 10 is not limited to inclusion of each of the above-listed portions nor to the first and second stiffened panels 1, 2 comprising the main body portion 10*a* or the first and second non-ribbed sections 3, 4 and mounting flange 5 comprising the tail portion 10*b*. The starter vent sheet 10 may be otherwise configured to perform the normal operation of the starter vent sheet 10, as would be obvious to one having ordinary skill in the art.

The first non-ribbed section 3 is preferably separated from the second non-ribbed section 4 by a first living hinge 16 that permits pivoting of the first non-ribbed section 3 relative to the second non-ribbed section 4. Pivoting on the first non-ribbed section 3 relative to the second non-ribbed section 4 permits the starter vent sheet 10 to adapt its shape for insertion into the building structure. Preferably, the first non-ribbed section 3 is also connected to the second stiffened panel 2 by a second living hinge 17 to provide greater flexibility in the positioning of the starter vent sheet 10. Mounting the tail portion 10*b* to the building structure and adapting the shape of the starter vent sheet 10 for installation into the building proximate a soffit area 48 of the building is described in detail in U.S. Pat. No. 7,094,145, which is incorporated herein by reference.

The first stiffened panel 1 and the second stiffened panel 2 are separated by a planar portion 18 that permits the second stiffened panel to bend relative to the orientation of the first stiffened panel. The planar portion 18 is preferably integrally molded into the main body portion 10*a*. The first and second stiffened panels 1, 2 are preferably ribbed longitudinally such that they are relatively rigid in comparison to the tail portion 10*b*, and in comparison to the planar portion 18. The ribbed configuration of the stiffened panels 1, 2 defines longitudinal channels extending from end to end of the main body portion 10*a* in an installed configuration for the venting of air beneath the roof 14, as would be understood by one having ordinary skill in the art.

The bending between the first stiffened panel land the second stiffened panel 2 and the pivoting between the second stiffened panel 2 and the first and second non-ribbed sections 3, 4 about the first and second living hinges 16, 17 is preferred so that the starter vent sheet 10 is adapted for installation into the soffit area (FIG. 9) or onto a ridge board 20 proximate a peak of the roof 14 (FIG. 10) or at nearly any location between the peak and the soffit area 48 of the roof 14 as required for the construction of a cathedral ceiling. In addition, the starter vent sheet 10, based upon inclusion of the ribbed main body portion 10*a* and the first and second living hinges 16, 17, permits installation of the starter vent sheet 10 at the ridge board 20 while providing continuous ventilation beneath the roof 14 along an entire length of the main body portion 10*a*. The starter vent sheet 10 is not limited to inclusion of the first and second living hinges 16, 17 and may be constructed and adapted for mounting in the soffit area 48 and proximate the ridge board 20 of the building structure in alternative manners to permit continuous venting of moisture beneath the roof 14 in a cathedral ceiling portion of the building structure, as would be obvious to one having ordinary skill in the art.

The intermediate sheet vent 12 is preferably comprised of a ribbed, generally rectangular sheet constructed of the PVC material. The preferred intermediate vent sheet 12 includes a first end 22, a second end 24, a first side 26, and a second side 28. The intermediate vent sheet 12 also preferably includes a longitudinal axis 30 and a lateral axis 32. The first and second ends 22, 24 are spaced along the longitudinal axis 30 and the first and second sides 26, 28 are spaced along the lateral axis 32. The intermediate vent sheet 12 also preferably includes a length dimension measured parallel to the longitudinal axis 30 from the first end 22 to the second end 24 and a width dimension measured along the lateral axis 32 from the first side 26 to the second side 28. In the first preferred embodiment, the length dimension is approximately forty-eight inches (48") and the width dimension is approximately fourteen and one-half inches (14½"). The starter vent sheet 10 also preferably has a width dimension that is the same or similar to the width dimension of the intermediate vent sheet 12 for insertion between adjacent rafters 46, as will be understood by one having ordinary skill in the art. The intermediate vent sheet 12 is not limited to the above-listed length and width dimensions and may have nearly any length or width that is appropriate for a specific building structure, as will be described in greater detail below and will be understood by one having ordinary skill in the art.

The intermediate vent sheet 12 also preferably includes a plurality of intermediate longitudinal ribs 34 that extend generally parallel to the longitudinal axis 30 from the first end 22 to the second end 24 and a plurality of intermediate lateral ribs 36 that extend generally parallel to the lateral axis 32 from the first side 26 to the second side 28. The intermediate longitudinal ribs 34 and the intermediate lateral ribs 36 preferably provide stiffness for the intermediate vent sheet 12. In addition, the intermediate longitudinal ribs 34 define a plurality of vent channels 38 that extend generally parallel to the longitudinal axis 30 between the first and second ends 22, 24. The vent channels 38 provide a pathway air flow parallel to the longitudinal axis 30 from the first end 22 to the second end 24 of the intermediate vent sheet 12 when the vent sheet 12 is mounted to the underside of the roof 14, as will be described in greater detail below.

In addition, the intermediate lateral ribs 36 provide lateral stiffness for the intermediate vent sheet 12 and create edges 36*a* or discontinuities in the longitudinal direction, due to the transformation of the cross-section from flattened surfaces to rounded surfaces, as noted in a comparison between FIGS. 6 and 8. These edges 36*a* are engagable when a first intermediate vent sheet 12 is stacked with a second intermediate vent sheet 12, or when the intermediate vent sheet 12 is stacked with a starter sheet 10, as will be described in greater detail below, to restrict longitudinal movement of the intermediate sheets. The intermediate vent sheet 12 is not limited to inclusion of the intermediate lateral ribs 36 and the edges 36*a* having the particular shape and configuration shown in the attached figures and may have nearly any shape, size or configuration that permits the intermediate vent sheet 12 to perform its typical functions, as is described in greater detail below.

Figure 3:
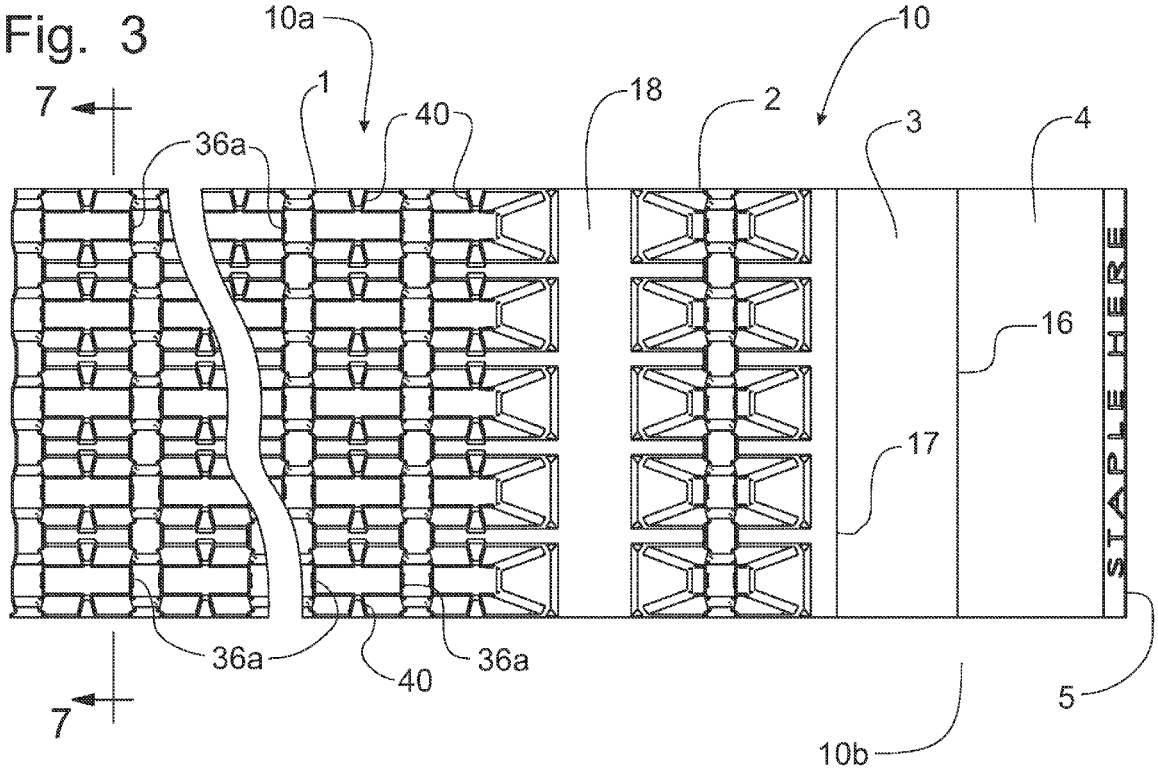
FIG. 3 is a plan view of the starter vent showing the interior surface as depicted in FIG. 1.
Figure 4:
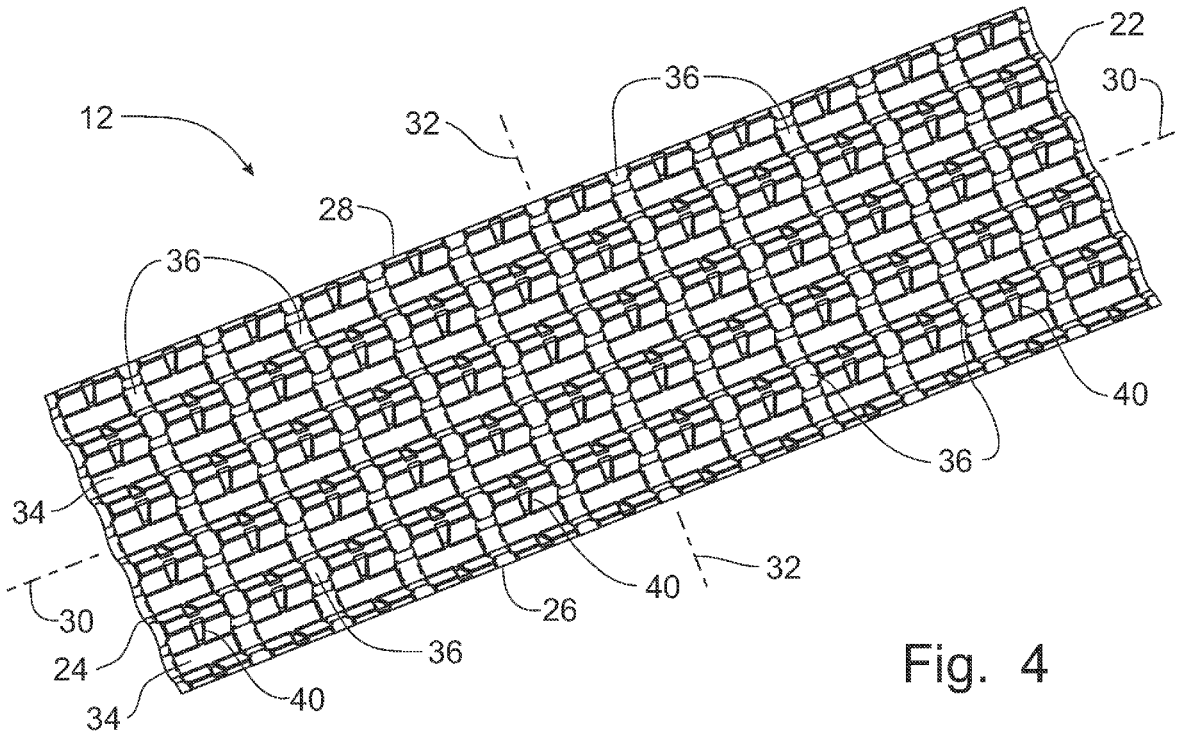
FIG. 4 is a perspective view showing the interior surface of an intermediate vent of the vent baffle assembly in accordance with a first preferred embodiment of the present invention.
Figure 5:
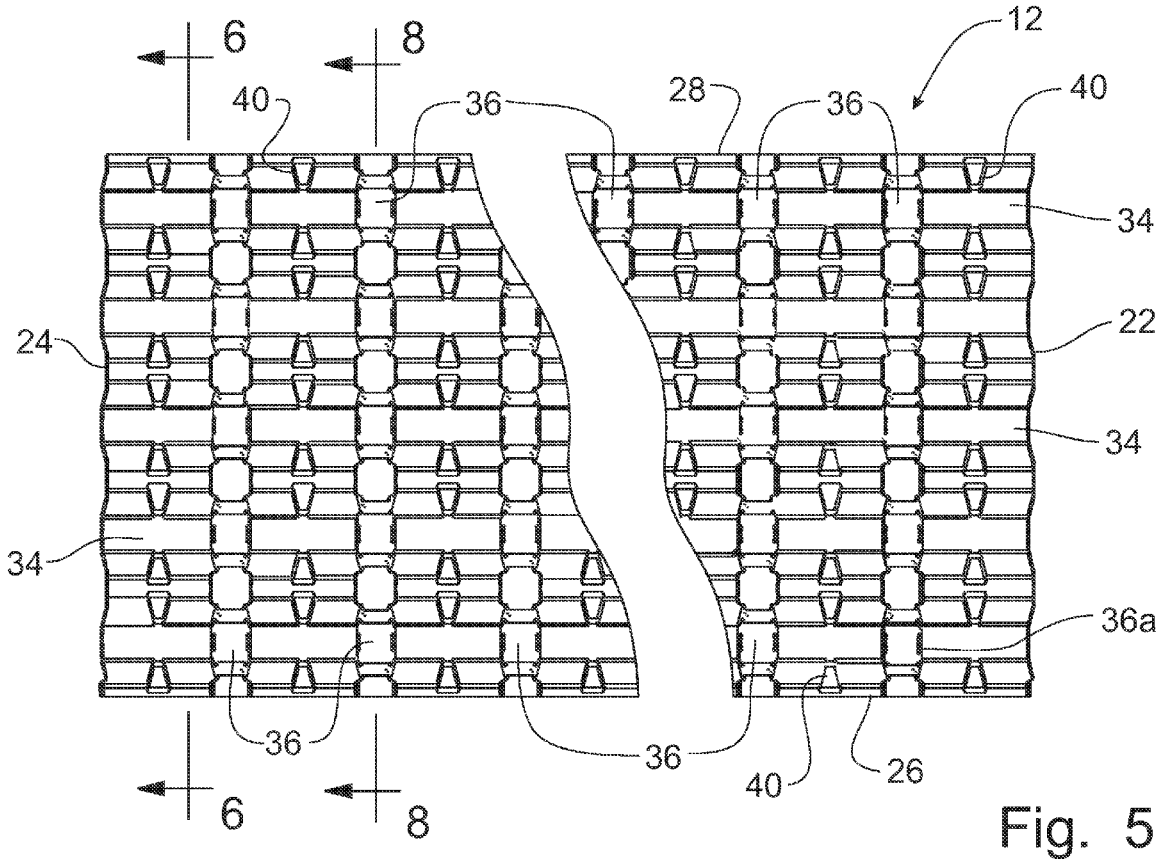
FIG. 5 is a plan view of the intermediate vent sheet shown in FIG. 4.

Referring to FIGS. 1-3, the first stiffened panel 1 and second stiffened panel 2 include a rib pattern that is generally identical to the rib pattern of the intermediate vent sheet 12, including the intermediate longitudinal ribs 34 and the intermediate lateral ribs 36 having the discontinuities or edges 36*a*. Accordingly, when the starter vent sheet 10 is mounted to the roof 14 proximate the soffit area 48 and/or to the ridge board 20, the starter vent sheet 10 may be secured to or interlocked with an intermediate vent sheet 12 through the intermediate longitudinal ribs 34, intermediate lateral ribs 36 and edges 36*a* of the main body portion 10*a* and the intermediate vent sheet 12, as will be described in greater detail below.

Referring to FIGS. 1-8, the starter vent sheet 10 and intermediate vent sheet 12 include supplemental ribs 40 that preferably extend from sides of the intermediate longitudinal ribs 34 between adjacent intermediate lateral ribs 36. The supplemental ribs 40 provide additional stiffness for the intermediate vent sheet 12, the first stiffened panel 1 and the second stiffened panel 2, and provide an additional locking or securing mechanism for securing the starter vent sheet 10 and/or the intermediate vent sheets 12 to each other in an assembled or installed configuration. The starter vent sheet 10 and intermediate vent sheet 12 are not limited to inclusion of the supplemental ribs 40 and may perform their function without inclusion of the supplemental ribs 40 or with additional alternatively configured supplemental ribs. However, the supplemental ribs 40 are utilized in the starter vent sheet 10 and intermediate vent sheet 12 to provide an additional engagement or securing feature between the intermediate vent sheets 12 and/or starter vent sheet 10 when they are engaged and installed in the roof 14.

Referring to FIGS. 1-10, in operation, the starter vent sheet 10 is preferably initially mounted in the building structure by positioning the second non-ribbed section 4 on a top plate 42 such that the mounting flange 5 is positioned on an inner surface of the top plate 42 at the top of a wall stud 54. The mounting flange 5 is secured to the inner surface of the top plate 42, preferably by stapling, and the first non-ribbed section 3, second stiffened panel 2, and first stiffened panel 1 bend inwardly toward the roof 14 prior to insertion between two adjacent roof rafters 46. Further bending the main body portion 10*a* relative to the already secured mounting flange 5 about the first living hinge 16, the second living hinge 17 and the planar portion 18, the first and second stiffened panels 1, 2 are positioned between the adjacent roof rafters 46, generally in the installed configuration shown in FIG. 9.

The width dimension of the starter vent sheet 10 is preferably slightly larger than a space between the adjacent roof rafters 46. Specifically, a majority of building structures having cathedral ceiling constructions utilize sixteen inch (16") on center rafters including two inch (2") wide roof rafters 46 having a nominal width of about 1⅝ inches, resulting in a fourteen inch (14⅜ ") space between the adjacent roof rafters 46. Accordingly, the preferred fourteen and one-half inch (14½ ") width dimension of the starter vent sheet 10 and the intermediate vent sheets 12 results in an interference fit of the starter vent sheet 10 and the intermediate vent sheet 12 between the adjacent roof rafters 46. This interference fit permits an operator to push or urge the first and second stiffened panels 1, 2 and the intermediate vent sheet 12 into the space between the adjacent roof rafters 46 against the roof sheathing 56. When the first and second stiffened panels 1, 2 and the intermediate vent sheet 12 are released by the operator or installer, the first and second stiffened panels 1, 2 and intermediate vent sheet 12 are retained between the adjacent roof rafters 46 by an inherent spring action of the first and second stiffened panels 1, 2 and intermediate vent sheet 12. If necessary in some installations, a staple can be placed through a rib 34 or 36 into the roof sheathing to help retain the vent baffle 10 in place between the rafters 46.

The operator may install the starter vent sheet 10 by securing the mounting flange 5 to the top plate 42, urging the first and second stiffened panels 1, 2 into the space between the adjacent roof rafters 46 and releasing the first and second stiffened panels 1, 2 such that they are retained between the roof rafters 46 typically without the need for fastening. The starter vent sheet 10 is not limited to having a width dimension of fourteen and one-half inches (14½ ") or to being force fit between the adjacent roof rafters 46 for an interference fit and being secured therebetween without the need for fasteners. For example, the width dimension of the starter vent sheet 10 may be identical or slightly smaller than the spacing between the roof rafters 46 and the first stiffened panel 1 may be fastened, preferably by stapling, to a roof sheathing 56 of the roof 14. In addition, the mounting flange 5 is not limited to being secured by stapling to the inner side of the top plate 42 and the tail portion 10*b* of the starter vent sheet 10 may be secured by stapling or otherwise fastening the second non-ribbed section 4 to a top surface of the top plate 42 or otherwise securing the tail portion 10*b* to an outside surface of the top plate 42 proximate the soffit vent 48. In addition, the tail portion 10*b* may be secured by flaps (not shown) that extend onto adjacent ceiling rafters 46 and secure the tail portion 10*b* to the building structure such that air flow through the soffit vent 48 generally does not displace the tail portion 10*b* or second stiffened panel 2.

Intermediate vent sheets 12 are subsequently engaged, preferably with at least one of the plurality of intermediate lateral ribs 36 or supplemental ribs 40 in engagement between the same features of the main body portion 10*a* or subsequent intermediate vent sheets 12, thereby securing the starter vent sheet 10 or intermediate vent sheets 12 together extending upwardly on an underside of the roof 14. Each of the main body portion 10*a* and the intermediate vent sheets 12 is preferably engaged between the adjacent roof rafters 46 by the interference fit such that one side of the main body portion 10*a* or intermediate vent sheets 12 is in contact with the roof sheathing 56 and air flow or vent channels 38 are created between the intermediate longitudinal ribs 34 and the roof sheathing 56 for carrying moisture away from the roof sheathing 56.

Figure 10:
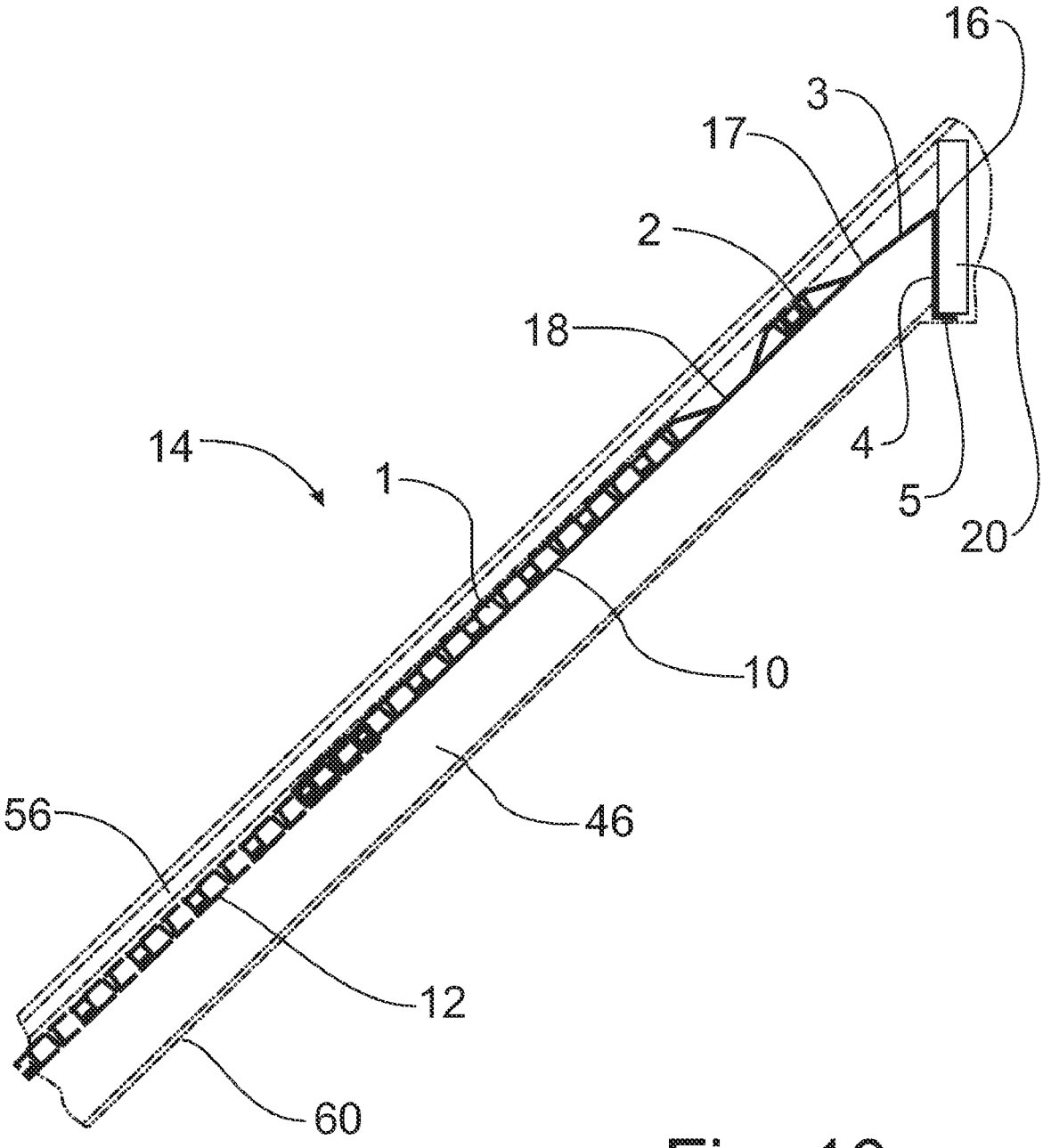
FIG. 10 is a vertical cross-sectional view through the roof and ceiling of the building structure, showing the starter vent sheet of FIG. 1 and a portion of an intermediate vent sheet of FIG. 4 in an installed configuration proximate a ridge board or peak of the building structure constructed with a cathedral ceiling.

Referring to FIG. 10, when installation of the intermediate vent sheets 12 reaches a point in the roof 14 where the next intermediate vent sheet 12 being installed would impact the ridge board 20, peak or other feature between the rafters 46 of the roof 14, another starter vent sheet 10 is obtained. The starter vent sheet 10 is engaged with the roof 14 and ridge board 20 preferably by stapling the mounting flange 5 to an underside of the ridge board 20 or stapling the second non-ribbed section 4 to a side surface of the ridge board 20 facing the roof sheathing 56. The starter vent sheet 10 is then bent about the first and second living hinges 16, 17 to position the starter vent sheet 10 and, specifically, the first non-ribbed section 3, the second stiffened panel 2 and the first stiffened panel 1 in an installed position, as is shown in FIG. 10. Accordingly, the intermediate longitudinal ribs 34 in the second stiffened panel 2 create air flow channels or vent channels 38 with the roof sheathing 56 to permit air flow.

Figure 9:
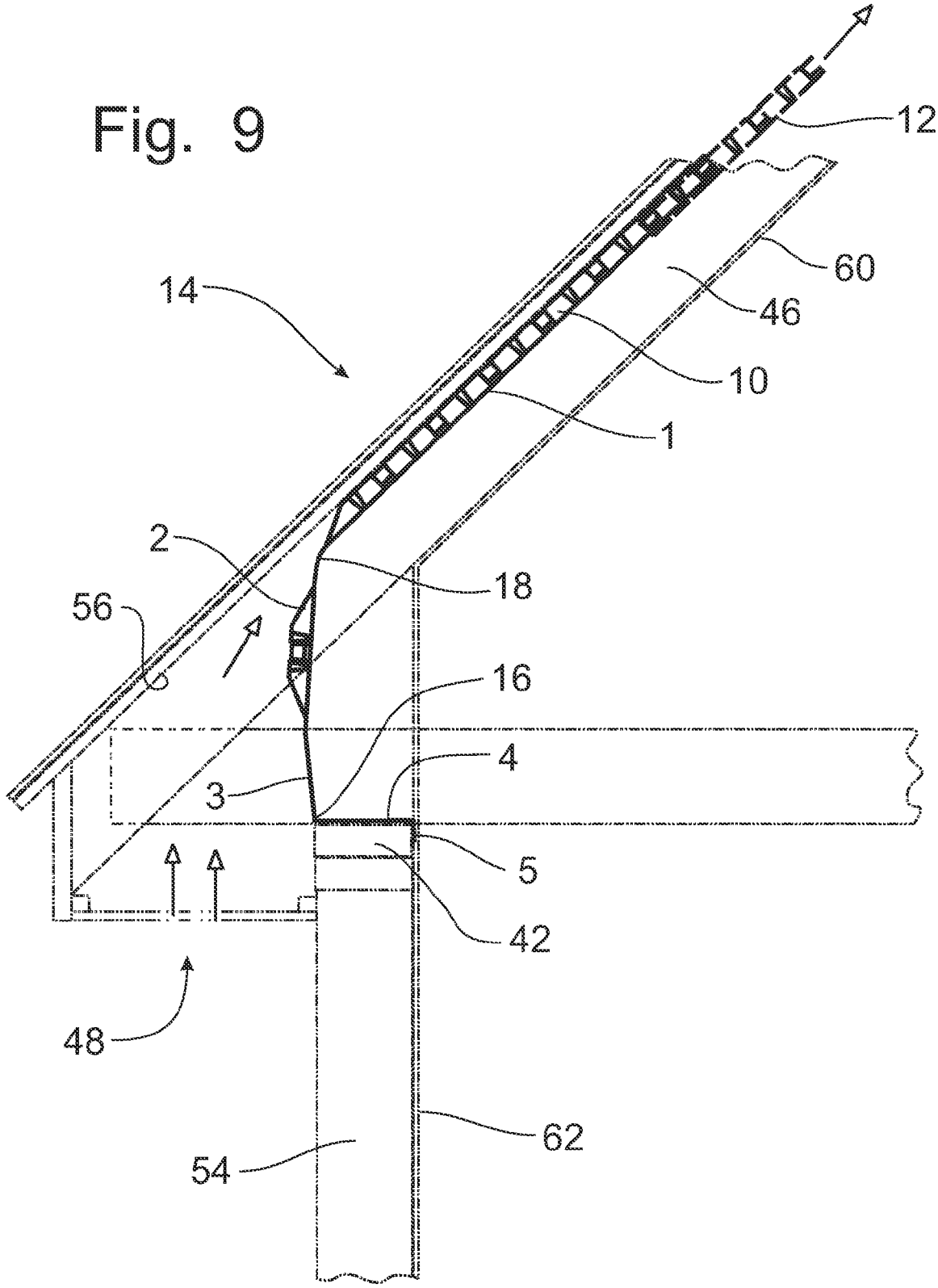
FIG. 9 is a partial vertical cross-sectional view through a roof, wall and ceiling of a building structure, showing the starter vent sheet of FIG. 1 and a portion of an intermediate vent sheet of FIG. 4 in an installed configuration proximate a soffit area of the building structure constructed with a cathedral ceiling.

Referring to FIGS. 8 and 9, when an entire area between the soffit vent 48 and peak or ridge board 20 of a bay between adjacent roof rafters 46 is assembled with starter and intermediate vent sheets 10, 12, thereby creating generally continuous airflow or vent channels 38 between the soffit vent 48 and the ridge board 20 or peak of the building structure, insulation is inserted into the bay between the adjacent roof rafters 46 on the installed starter and intermediate vent sheets 10, 12. The insulation may be of a conventional bat, foam or celluloid-type to fill a volume between the starter and intermediate vent sheets 10, 12 and a ceiling board 60 or a wall board 62 that is mounted to the wall stud 54 and/or roof rafters 46 to create a wall or cathedral ceiling of the building structure. One skilled in the art will note that the vent structure can be formed with a starter vent sheet 10 at the soffit area 48 and at the ridge pole 20 with the gap between the two starter vent sheets 10 being covered by one or more intermediate vent sheets 12. If the area to be vented is sufficiently small, and the starter vent sheets 10 are sufficiently long, no intermediate vent sheets 12 may be necessary.

When the cathedral ceiling vent assembly comprised of the starter vent sheets 10 and intermediate vent sheets 12 are completely installed in a cathedral ceiling area of a roof 14 of a building structure, air venting may occur between an outlet and the soffit vent 48 of the building structure along the entire length of the roof 14. The cathedral ceiling vent assembly of the present application generally prevents moisture from collecting beneath the roof 14 and provides insulation for cathedral ceilings of a building structure. The starter vent sheet 10 and intermediate vent sheet 12 are relatively simple for an operator to install, resilient, stiff, resistant to crushing during installation and are resistant to most types of corrosion due to being constructed of the PVC material.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention.

Having thus described the invention, what is claimed is:

1. A vent baffle assembly for a cathedral ceiling to provide air ventilation in a cathedral ceiling portion of a building structure from a soffit area along roof sheathing affixed to rafter beams to an elevated vent, the vent baffle assembly comprising:

a first vent sheet having a first longitudinal axis and a first lateral axis perpendicular to said first longitudinal axis, and including a first longitudinal rib extending parallel to said first longitudinal axis and a first lateral stiffener extending parallel to said first lateral axis; and a second vent sheet having a second longitudinal axis and a second lateral axis perpendicular to said second longitudinal axis, and including a second longitudinal rib extending parallel to said second longitudinal axis and a second lateral stiffener extending parallel to said second lateral axis, the first and second vent sheets being positioned between two adjacent rafter beams such that the first and second longitudinal axes are generally parallel to the rafter beams, the first and second vent sheets overlapping such that the first longitudinal rib engages the second longitudinal rib to limit lateral movement between said first and second vent sheets, with the first lateral stiffener engaging the second lateral stiffener to limit longitudinal movement between said first and second vent sheets.

2. The vent baffle assembly of claim 1 wherein said first vent sheet is formed with a first main body portion incorporating said first longitudinal rib, and a generally planar first tail portion, said first main body portion being positioned between said adjacent said rafter beams, said first tail portion being oriented angularly to said first main body portion and being affixed to said building structure at said soffit area.

3. The vent baffle assembly of claim 2 wherein the first and second vent sheets are constructed of a polymeric material.

4. The vent baffle assembly of claim 3 wherein said first main body portion is formed with a first ribbed member and a second ribbed member connected together by a planar portion, said first tail portion being formed with a pair of generally planar members pivotally connected together by a living hinge.

5. The vent baffle assembly of claim 2 wherein both the first main body portion of said first vent sheet and second vent sheet include a plurality of longitudinal ribs and a plurality of lateral stiffeners extending across said longitudinal ribs, each said longitudinal rib being formed with planar sides while each said lateral stiffener is formed with an arcuate cross-section such that each said lateral stiffener forms a discontinuity along each longitudinal rib to define an edge against which first and second lateral stiffeners can engage and limit longitudinal movement between said first and second vent sheets.

6. The vent baffle assembly of claim 5 further comprising a third vent sheet having a second main body portion formed with a plurality of third longitudinal ribs and a plurality of third lateral stiffeners in substantially identical configuration to said first and second vent sheets, said third vent sheet further having a second generally planar tail portion affixed to said building structure near said elevated vent, said second main body portion being positioned between said adjacent rafter beams and engaged with said second vent sheet with at least one of said third lateral stiffeners engaging a corresponding said second lateral stiffener.

7. A vent baffle assembly for a building structure having a wall and rafter beams supporting roof sheeting and extending between said wall and an upper structural member, said building structure being formed with a cathedral ceiling having a ceiling panel affixed to said rafter beams, comprising:

a first starter vent panel having a first tail portion affixed to said wall and a first main body portion formed in a ribbed configuration positioned between adjacent said rafter beams; and a second starter vent panel having a second tail portion affixed to said upper structural member and a second main body portion positioned between said adjacent said rafter beams.

8. The vent baffle assembly of claim 7 further comprising:

at least one intermediate vent panel extending between said first and second starter vent panels, said at least one intermediate panel having a ribbed configuration conforming to said ribbed configuration of said first and second main body portions.

9. The vent baffle assembly of claim 8 wherein each said tail portion is formed with a pair of generally planar members pivotally connected together, and each said main body portion being formed with a first ribbed member and a second ribbed member connected together.

10. The vent baffle assembly of claim 9 wherein said first ribbed member is positioned between said adjacent said rafter beams, said second ribbed member being attached to said first planar member, said second planar member including a mounting flange.

11. The vent baffle assembly of claim 9 wherein said starter vent panel is formed of thermoplastic material, said first and second ribbed members being connected by a planar portion, said first and second planar members being connected by a living hinge.

12. The vent baffle assembly of claim 8 wherein each said main body portion and said at least one intermediate vent panel are formed with longitudinally extending ribs defining air passages between said vent baffle assembly and said roof sheathing when said vent baffle assembly is installed against said roof sheathing between said adjacent said rafter beams, the interengagement of said longitudinal ribs between said at least one intermediate vent panel preventing lateral movement therebetween.

13. The vent baffle assembly of claim 12 wherein each said main body portion and said intermediate vent panel are formed with laterally extending ribs defining discontinuities along said longitudinal ribs such that interengaged discontinuities of said at least one intermediate panel and said main body portions prevent longitudinal displacement therebetween.

14. A vent baffle assembly for use in a building structure having a cathedral ceiling formed by rafter beams extending from a soffit area at a wall to an upper support member and supporting roof sheathing on an upper side thereof and a ceiling member on a lower side thereof, comprising:

a first starter vent panel having a first main body portion formed with at least one longitudinally extending rib and at least one laterally extending rib, and a first tail portion integrally formed with said main body portion and being positionable at an angle relative to said main body portion, at least a portion of said first main body portion being positionable between adjacent rafter beams to provide a passageway for movement of air from said soffit area to said upper support member, said first tail portion being engagable with said wall;

a second starter vent panel having a second main body portion and a second tail portion angularly positionable relative to said second main body portion, said second main body portion being formed with at least one longitudinally extending rib and at least one laterally extending rib, said at least one longitudinally extending rib on said second starter vent panel being alignable with the at least one longitudinally extending rib of said first starter vent panel; and an intermediate vent panel extending between said first and second starter vent baffles and being formed with at least one longitudinally extending rib and at least two laterally extending ribs, said at least one longitudinally extending rib on said second starter vent panel being alignable with the at least one longitudinally extending ribs of both said first and second starter vent panels to restrict lateral movement of said intermediate vent panel relative to either of said starter vent panels, said laterally extending ribs of said intermediate vent panel being engagable with respective laterally extending ribs on said first and second starter vent panels to restrict longitudinal movement of said intermediate panel relative to either of said starter vent panels.

15. The vent baffle assembly of claim 14 wherein said laterally extending ribs defining discontinuities to permit an interengagement of the laterally extending ribs of said intermediate vent panel with respective laterally extending ribs of said first and second starter vent panels.

16. The vent baffle assembly of claim 15 wherein said each of said first and second starter vent panels and said intermediate vent panel are formed with a plurality of laterally extending ribs and a plurality of longitudinally extending ribs which define a corresponding cross-sectional configuration of each of said first and second starter vent panels and said intermediate vent panel to permit said intermediate vent panel to mate with each of said first and second starter vent panels.

17. The vent baffle assembly of claim 16 wherein each said tail portion is formed with a pair of generally planar members connected together by a first living hinge, each said main body portion being formed with a first ribbed member and a second ribbed member separated by an integral planar portion.

18. The vent baffle assembly of claim 17 wherein said first ribbed member of both of said first and second starter vent panels are positioned between adjacent said rafter beams, said first tail portion being attached to said wall and said second tail portion being attached to said upper support member.

19. The vent baffle assembly of claim 18 wherein each said second ribbed member and a corresponding first planar member of said tail portion are pivotally connected by a second living hinge.

20. The vent baffle assembly of claim 19 wherein said first and second starter vent panels and said intermediate vent panel have a transverse width that is greater than a corresponding transverse distance between said adjacent rafter beams to permit said first and second starter vent panels and said intermediate vent panel to form an interference fit between said adjacent rafter beams.

* * * * *